US007610724B2

(12) United States Patent
Houk, Jr.

(10) Patent No.: US 7,610,724 B2
(45) Date of Patent: Nov. 3, 2009

(54) SHED ROOF TRUSS ADAPTED FOR STORING LONG HANDLE TOOLS

(75) Inventor: David A. Houk, Jr., Norton, OH (US)

(73) Assignee: Rubbermaid Incorporated, Huntersville, NC (US)

( * ) Notice: Subject to any disclaimer, the term of this patent is extended or adjusted under 35 U.S.C. 154(b) by 830 days.

(21) Appl. No.: 10/874,658

(22) Filed: Jun. 23, 2004

(65) Prior Publication Data

US 2005/0005537 A1 Jan. 13, 2005

Related U.S. Application Data

(60) Provisional application No. 60/480,716, filed on Jun. 23, 2003.

(51) Int. Cl.
*E04D 13/00* (2006.01)
*E04D 3/36* (2006.01)

(52) U.S. Cl. ..... 52/90.1; 52/93.1; 52/634; 52/636; 211/70.6

(58) Field of Classification Search ..... 52/79.1, 52/79.5, 634, 636, 635, 633, 220.7, 93.1, 52/90.1, 36.2, 36.4, 39, 41, 44; 248/250, 248/235, 247, 248
See application file for complete search history.

(56) References Cited

U.S. PATENT DOCUMENTS 1,644,940 A * 10/1927 Moyer ..... 29/897.31
2,201,504 A * 5/1940 Ruppel ..... 52/635
2,726,743 A * 12/1955 Short et al. ..... 52/632
3,019,861 A * 2/1962 Rasch et al. ..... 52/639
3,066,394 A * 12/1962 Litzka ..... 29/564.2
3,137,098 A * 6/1964 Elia et al. ..... 52/170
3,146,864 A * 9/1964 Nystrom et al. ..... 52/93.2
3,150,463 A * 9/1964 Nearing et al. ..... 52/92.2
3,224,151 A * 12/1965 Nystrom ..... 52/90.1
3,283,464 A * 11/1966 Litzka ..... 52/636
3,313,070 A * 4/1967 Elofson ..... 52/93.1
3,343,321 A * 9/1967 Axelsson ..... 52/296
3,414,300 A * 12/1968 Spane ..... 403/300
3,457,689 A * 7/1969 Troutner ..... 52/639
3,474,578 A * 10/1969 Wippermann ..... 52/92.3
3,494,089 A * 2/1970 Dickinson ..... 52/639
3,708,928 A * 1/1973 Gaspers ..... 52/93.1
3,785,108 A * 1/1974 Satchell ..... 52/645

(Continued)

FOREIGN PATENT DOCUMENTS

EP 8271 * 3/1979 ..... 52/93.1

(Continued)

*Primary Examiner*—Phi Dieu Tran A
(74) *Attorney, Agent, or Firm*—Dennis J. Williamson; Moore & Van Allen, PLLC

(57) ABSTRACT

A building comprises a side wall defining a storage space within the sidewall confines, a roof supported above the storage space, and a pair of gables above the sidewall and at opposite ends of the roof. At least one truss is disposed between the gables and adapted to support the roof and has at least one tool handle opening. In a part of the building separate from the truss is disposed at least one additional receiver generally across from the tool handle opening. The tool handle opening and the receiver are spaced apart and adapted to each receive the handle of a long handled tool and support the long handled tool above the storage space.

16 Claims, 5 Drawing Sheets

U.S. PATENT DOCUMENTS

| | | | | | |
|---|---|---|---|---|---|
| 3,798,853 | A | * | 3/1974 | Castle | 52/92.2 |
| 3,987,597 | A | * | 10/1976 | Smrt | 52/764 |
| 4,030,256 | A | * | 6/1977 | Ollman | 52/93.1 |
| 4,041,659 | A | * | 8/1977 | McElhoe | 52/93.1 |
| 4,069,627 | A | * | 1/1978 | Pegg | 52/93.1 |
| 4,073,458 | A | * | 2/1978 | Sease | 248/340 |
| 4,342,177 | A | * | 8/1982 | Smith | 52/93.1 |
| 4,583,333 | A | * | 4/1986 | Minter | 52/91.1 |
| 4,756,127 | A | * | 7/1988 | Helterbrand et al. | 52/93.1 |
| 4,773,192 | A | * | 9/1988 | Andrews | 52/93.1 |
| 4,858,398 | A | * | 8/1989 | Ricchini | 52/91.3 |
| 4,894,964 | A | * | 1/1990 | Thrift et al. | 52/93.1 |
| 4,961,297 | A | * | 10/1990 | Bernard | 52/93.1 |
| 5,033,489 | A | * | 7/1991 | Ferre et al. | 134/57 R |
| 5,189,983 | A | * | 3/1993 | Aitchison | 119/437 |
| 5,245,802 | A | * | 9/1993 | Davis | 52/86 |
| 5,457,927 | A | * | 10/1995 | Pellock et al. | 52/633 |
| 5,600,924 | A | * | 2/1997 | Forsberg | 52/93.2 |
| 5,937,591 | A | * | 8/1999 | Markey | 52/94 |
| 6,012,256 | A | * | 1/2000 | Aschheim | 52/167.1 |
| 6,223,476 | B1 | * | 5/2001 | Lemoine | 52/22 |
| 6,299,000 | B1 | * | 10/2001 | Cabrera | 211/70.2 |
| 2004/0187400 | A1 | * | 9/2004 | Anderson et al. | 52/79.1 |
| 2006/0000789 | A1 | * | 1/2006 | Pleiman et al. | 211/70.6 |

FOREIGN PATENT DOCUMENTS

| | | | | | |
|---|---|---|---|---|---|
| JP | 3-244763 | | * | 10/1991 | 52/79.1 |
| JP | 04106252 | A | * | 4/1992 | |
| JP | 6-49905 | | * | 2/1994 | 52/79.1 |

* cited by examiner 54
108
126
168
168
104
94
133
130
128
126
114
102
124
102
86
108
112
118
92
142
120
120
A2
88
110
A3
9
96
140
138
134
136
126
128
132
130
7
7
10
9
A4
11
11
10
106
102
A1
84
116
82
120
120
118
104
54
90
142
142

SHED ROOF TRUSS ADAPTED FOR STORING LONG HANDLE TOOLS

CROSS REFERENCE TO RELATED APPLICATION

This application is based on and claims priority to U.S. Provisional Application No. 60/480,716, which was filed on Jun. 23, 2003.

BACKGROUND OF THE INVENTION

1. Field of the Disclosure

The present disclosure is generally directed to storage sheds, and more particularly to a roof truss for a storage shed wherein the truss is adapted to store or assist in storing long handled tools such as shovels, rakes, brooms, and the like.

2. Description of Related Art

Long handled tools such as rakes and brooms are typically stored in a home or garage by placing them on the floor and resting the handles against a wall surface. Long handled tools generally include a cylindrical handle that can extend more than five feet, with a tool implement such as a shovel head on one end. Because the tools have long handles, storing them in this manner can take up excessive storage or wall space that could be used for storing or mounting more useful items such as shelving. The tool implement such as the shovel head or broom head also takes up excessive floor space that could be used for storing other items.

In another example, wall peg boards are mounted on a wall surface. Brackets are removably mounted to the board within holes of the board. Specific brackets are available for these peg boards that can store long handled tools in an elevated position. While this may be effective to alleviate the problem of the tool taking up floor space, the depending handle still takes up excessive space along the wall and prevents other items from being mounted to or stored on the board in any regions occupied by the handle.

In a further example, long handled tools can be stored upright in a large container, such as an open-topped can. Unfortunately, the container is susceptible to tipping if a large number of tools are on the same side of the container, and the haphazard gathering of many tools can appear cluttered.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The following describes a building that addresses the aforementioned deficiencies. The building includes at least one truss supporting a roof. The truss includes at least one tool handle opening. The building also includes a second receiving area adapted to receive a tool handle. The handle of a long-handled tool can be inserted through the tool handle opening and into the receiver such that the tool is supported in an elevated condition above the storage area in the building. In this manner, the long handled tool can be stored in an orderly manner in a location away from the interior walls of the building.

Figure 2:
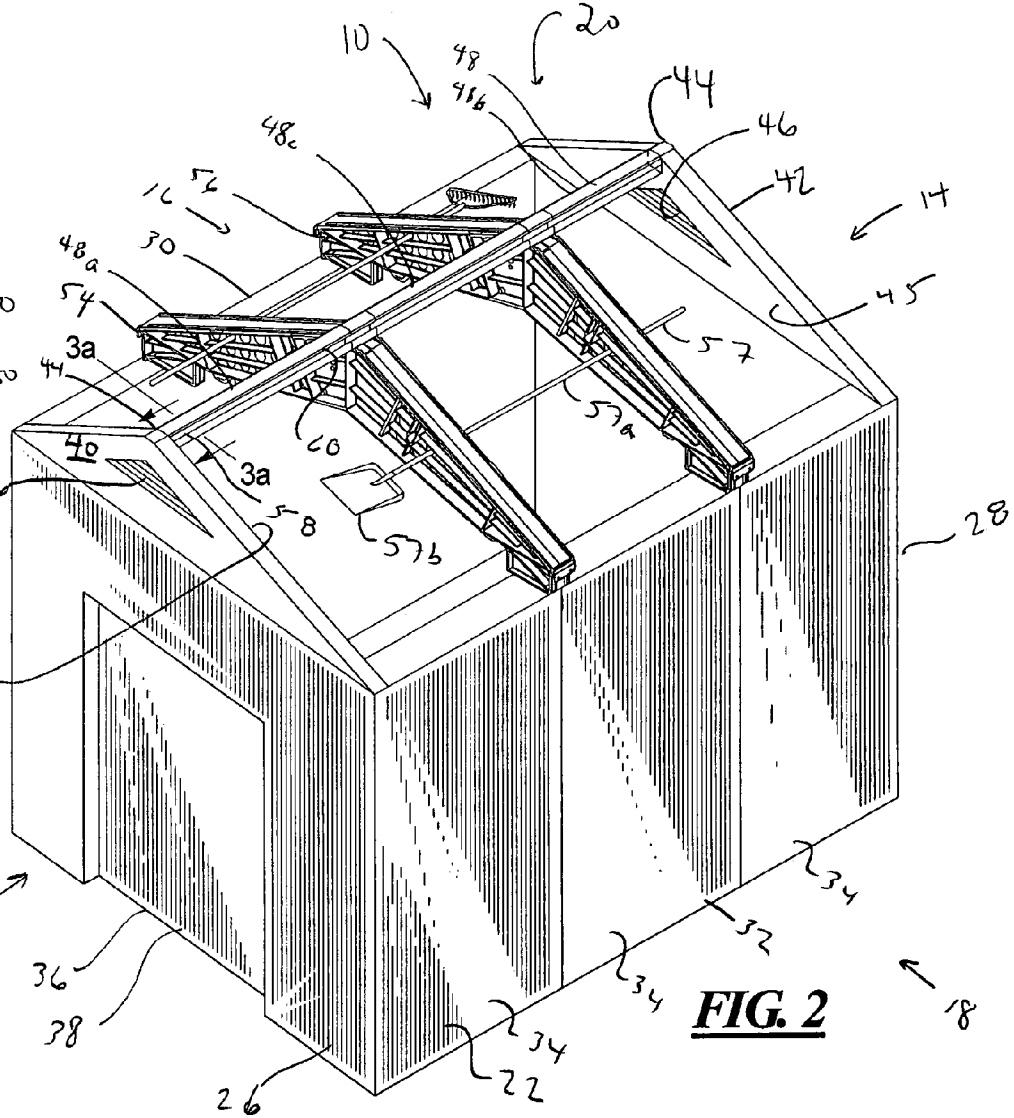
FIG. 2 depicts the storage shed of FIG. 1 with the roof panels removed and two roof trusses exposed.
Figure 1:
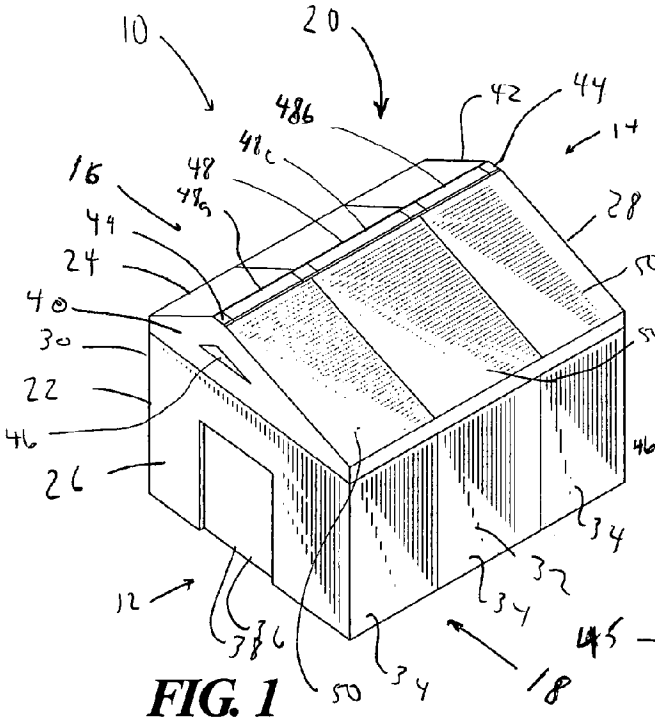
FIG. 1 depicts an example of a storage shed constructed in accordance with the teachings of this disclosure.

Referring now to the drawings, a building 10 is disclosed in FIGS. 1 and 2. In this example, the building is a tool shed. However a garage, storage compartment, edifice, enclosure or other building can be used. The building 10 has a front side 12, a rear side 14, a left side 16, a right side 18, and a top side 20. These directional labels are used for convenience of description only, and no limitation should be read therein. The building 10 includes a sidewall 22 and a roof 24 above the side wall 22. In this example, the side wall 22 is made of a front panel 26, a rear panel 28, a left panel 30, and a right panel 32 that combine to create a rectangular footprint. The left panel 30 and the right panel 32 are each constructed of three interconnected side panel sections 34. Other configurations of a side wall 22, such as cylindrical, are also possible. An entryway 36 is disposed in the side wall 22 to allow access into and out of the building 10. In this example, the entryway 36 is in the front wall 26 and includes a door 38 that is sized large enough to allow a person to enter and exit while carrying items into and out of the building 10.

Above the side wall 22 on the front side 12 is a front gable 40 and above the side wall 22 on the rear side 14 is a rear gable 42. Each gable 40, 42 is generally triangular in this example with an apex 44 and connects the side wall 22 to the roof 24 to help support the roof 24 in an elevated and angled state. The gables 40, 42 have generally closed faces 45 to also help to enclose the building 10. Each face 45 of the gables 40, 42 can include a vent 46 to allow air and heat transfer to occur between the interior of the building 10 and the atmosphere. In another example, each gable 40, 42 can simply be an upper portion of the sidewall 22.

A ridge beam 48 connects the front gable 40 to the rear gable 42 at the apex 44 of each gable 40, 42. The ridge beam 48 serves to strengthen the building 10 as well as to fasten the roof 24 to the building 10, as will be detailed later.

The roof 24 in this example includes a plurality of roof panels 50 that are interconnected to create a substantially water tight seal. In this example, the roof 24 includes a total of six roof panels 50. The panels 50 are angled downward from the ridge beam 48 to the left and right sides 16, 18 to ensure that rain is directed off to the left and right sides of the building 10. The roof 24 can be fastened to the building 10 at least along the ridge beam 48.

Referring now specifically to FIG. 2, the building 10 is depicted with the roof panels 50 removed. A first truss 54 is fastened to the side wall 22 and extends upward in a position to provide support to the roof panels 50 and further to attach the roof panels 50 to the building 10. In this example, the first truss 54 and a second truss 56 are shown. However, more or fewer trusses can be used depending on the size of the building 10 and the load of the roof 24 that the trusses 54, 56 must support, as is known. In this example, the trusses 54, 56 are directly fastened to and supported by the sidewall 22. However, other configurations are possible in which the trusses 54, 56 can be indirectly connected to the sidewall 22, such as using structural posts to support the trusses 54, 56 for example. In this example, the first truss 54 is generally similar to the second truss 56, and any reference describing the first truss 54 also describes the second truss 56 unless stated otherwise.

As is depicted in FIG. 2 and will be described in more detail later, the trusses 54, 56 can be used to support long handled tools 57 in the building to provide a cleaner and more orderly environment. In this example, the long handled tool 57 includes a handle 57*a* and an implement 57*b* such as a shovel head.

As can be seen, the ridge beam 48 is constructed of multiple ridge beam segments 48*a*, 48*b*, and 48*c*. In this example the first ridge beam segment 48*a* has a front portion 58 that is connected to the front gable 40 and a rear portion 60 connected to the first truss 54. In this manner, the first ridge beam segment 48*a* connects the front gable 40 to the first truss 54. Similarly, the second ridge beam segment 48*b* connects the rear gable 42 to the second truss 56. Because multiple trusses 54, 56 are used as shown in FIG. 2, a third ridge beam segment 48*c* connects the first truss 54 to the second truss 56.

Figure 3A:
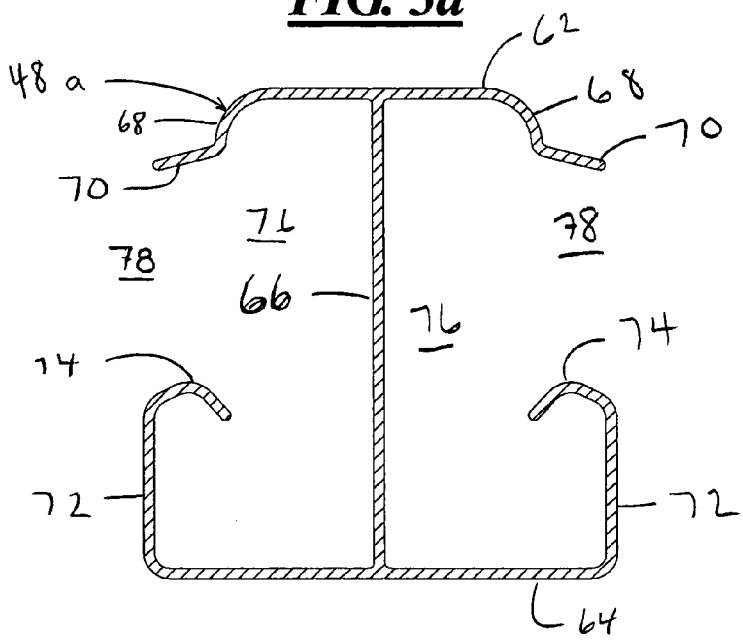
FIG. 3*a* depicts a cross section of a ridge beam, taken along line 3*a*-3*a* in FIG. 2

Referring now to FIG. 3*a*, a cross section of the first ridge beam segment 48*a* is shown. Each ridge beam segment 48*a*, 48*b*, 48*c* of the ridge beam 48 is constructed similarly, and thus, only the first ridge beam segment 48*a* will be described.

The first ridge beam segment 48*a* includes a top wall 62, a bottom wall 64, and a generally vertically oriented dividing wall 66 that connects the top wall 62 to the bottom wall 64 at each of their respective approximate midpoints. The first ridge beam segment 48*a* can be symmetric about the dividing wall 66. The top wall 62 includes a stepped portion 68 to create an upper lip 70. The bottom wall 64 includes a mid portion 72 that extends up toward the top wall 62 and a curved lip 74 that curves back inward toward the dividing wall 66. The top wall 62, bottom wall 64, and dividing wall 66 define a chamber 76 that is shaped and sized to receive a portion of a roof panel 50 to help secure the roof panel 50 to the building 10. The upper lip 70 and the curved lip 74 are shaped and sized to form an entrance 78 into the chamber 76 such that a portion of the roof panel 50 can be inserted through the entrance 78 into the chamber 76 and can be secured in the chamber 76 and to the building 10 by a snap fit between the upper lip 70 and the curved lip 74. Gasketing can be used to create a water tight seal.

Figure 3B:
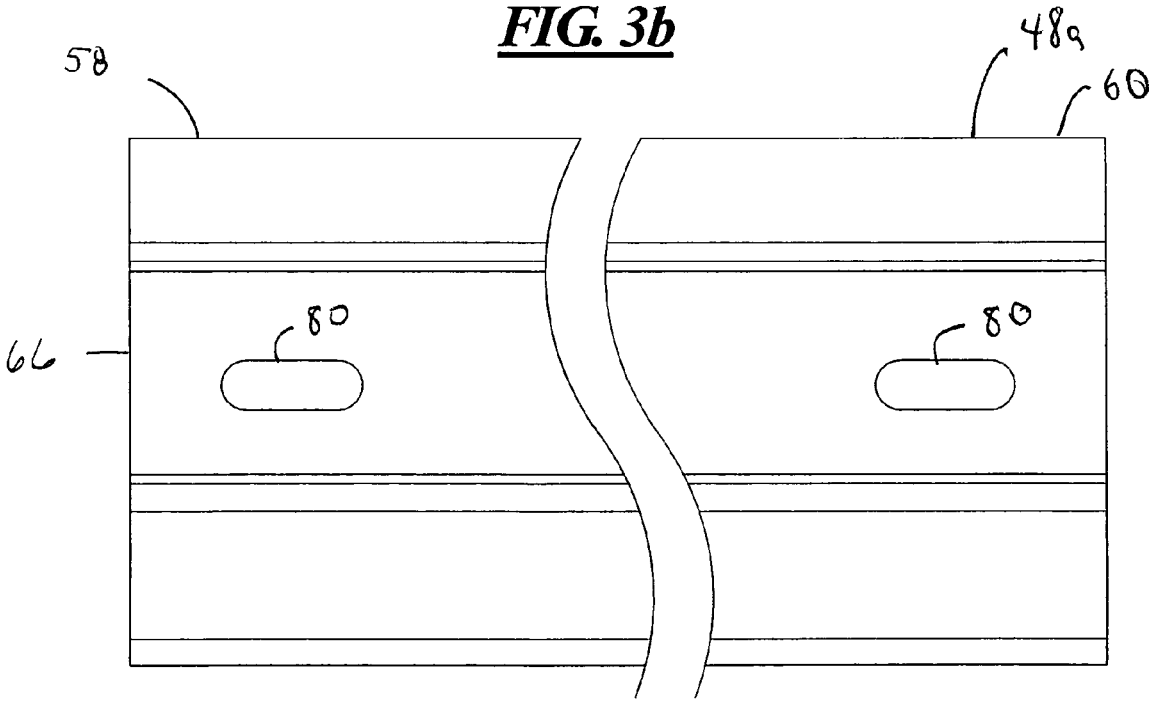
FIG. 3*b* depicts a side view of front and rear portions of the ridge beam.

Referring now to FIG. 3*b*, a side view of the front portion 58 and the rear portion 60 of the first ridge beam segment 48*a* is shown. The majority of the first ridge beam segment 48*a* is not depicted in this figure. Both the front portion 58 and the rear portion 60 include a fastener slot 80 disposed in the dividing wall 66 to facilitate the connection of the first ridge beam segment 48*a* to the truss 54 or the gable 40, 42, as will be detailed later.

Referring now to FIGS. 4-7, the truss 54 is shown in detail. The truss 54 includes a left top side 82, a left bottom side 84, a right top side 86, and a right bottom side 88. The truss 54 further includes a left corner 90, a right corner 92, an apex 94, and a base vertex 96. Finally, the truss 54 includes a front side 98 and a back side 100.

The left top side 82 and the left bottom side 84 of the truss 54 form an acute angle A1 with respect to each other, and the right top side 86 and the right bottom side 88 form an acute angle A2 with respect to each other. The left top side 82 and the right top side 86 meet at the apex 94 to form an obtuse apex angle A3, and the left bottom side 84 and the right bottom side 88 meet at the base vertex 96 and form an obtuse base angle A4. As shown, the apex and base angles A3, A4 are equal to or greater than 180° but can, however, be less than 180° as well.

The truss 54 includes a panel or surface 102 generally bounded by and extending between the sides 82-88. A first flange 104 is disposed on the edge of the panel 102 at or along the left top side 82. Similarly, a second flange 106, a third flange 108, and a fourth flange 110 are disposed on the respective edges of the panel 102 at or along the left bottom side 84, the right top side 86, and the right bottom side 88, respectively.

The truss 54 may include ribs 112 across the panel 102 to increase the load bearing capacity of the truss 54. A first rib 114 may extend from the apex 94 to the base vertex 96. Lateral ribs 116 may extend from the first rib 114 toward the left and right corners 90, 92. Finally, longitudinal ribs 118 may extend from the left top side 82 to the left bottom side 84 and from the right top side 86 to the right bottom side 88. As is known, the ribs 112 strengthen the truss 54 and allow it to bear a greater load without failure than a truss 54 without ribs.

The truss 54 may further include at least one hook 120 extending downward from the left bottom side 84 or the right bottom side 88. In this example, two hooks 120 each extend down from the left bottom side 84 and the right bottom side 88. The hooks 120 can be used to conveniently hang items such as electrical cords, tape rolls, etc.

The truss 54 includes at least one opening 122 that extends through the panel 102. The opening 122 can be molded into or otherwise formed in the truss 54 or cut out from the truss 54 in an operation after the truss 54 is formed. In this example, a plurality of openings 122 are disposed in the truss 54 interspersed with the ribs 112. The openings 122 in this example include a variety of sizes that are shaped and sized to receive a handle 57*a* of a long-handled tool 57, as shown in FIG. 2. Each opening 122 can have a rounded, radiused, or filleted edge 124 on one or both sides to facilitate the insertion of the handles 57*a* of the tools 57. In this example, generally circular openings 122 are shown. However, other shapes of openings 122 can be included, such as oval, rectangular, etc., depending on the item that is to be stored. Also, the truss 54 can include a variety of different shapes and sizes of openings 122.

Figures 5, 6, 7:
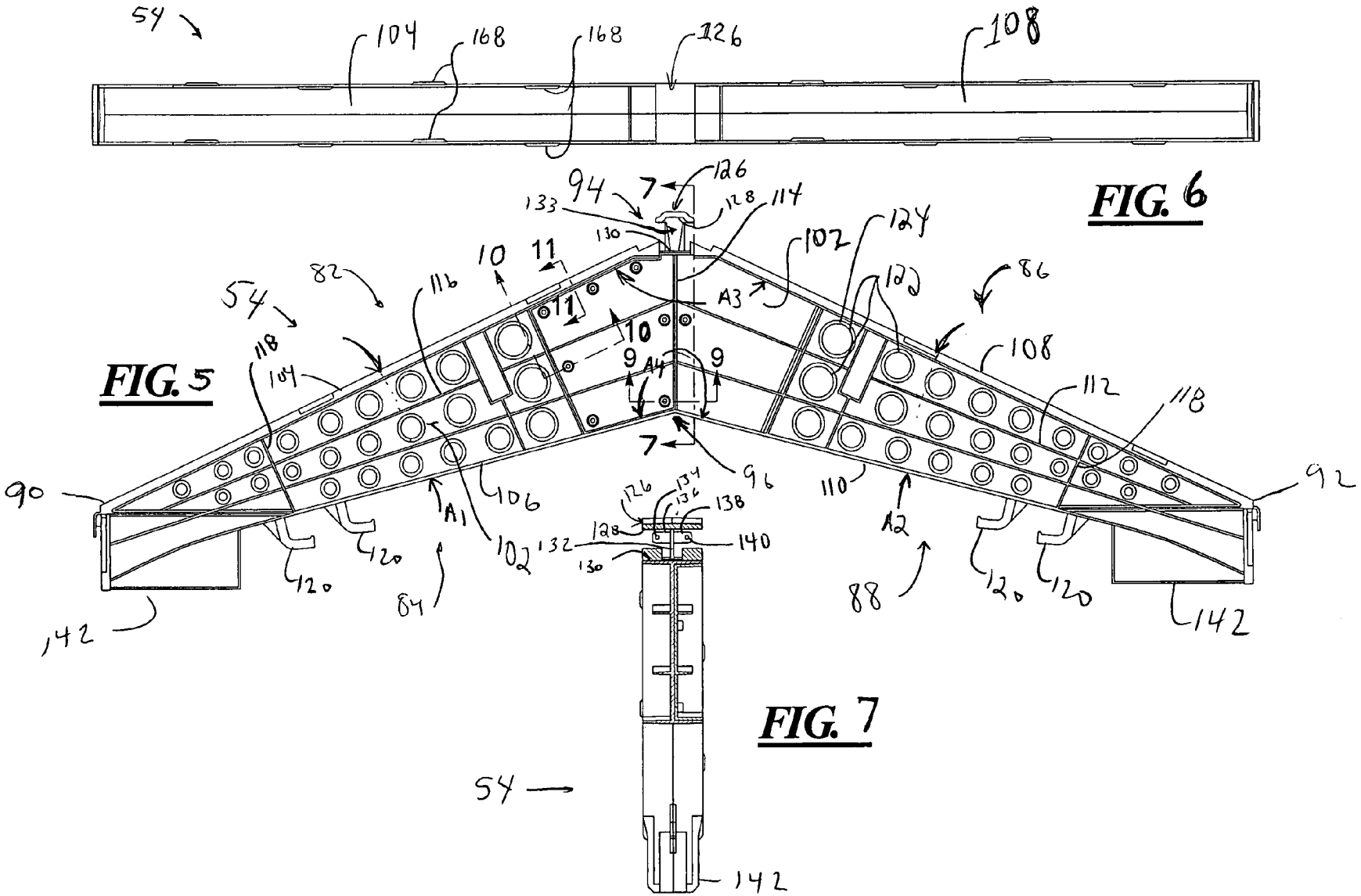
FIG. 5 depicts a rear view of the roof truss of FIG. 4.
FIG. 6 depicts a top view of the roof truss shown in FIG. 4.
FIG. 7 depicts a cross section of the roof truss taken along line 7-7 in FIG. 5.

As shown in FIGS. 5 and 7, a beam receiver 126 is disposed on the truss 54 at approximately the apex 94 of the truss 54. The beam receiver 126 is shaped generally complementary to the rear portion 60 of the first ridge beam segment 48*a* such that the first ridge beam segment 48*a* can slide into the beam receiver 126 and the two can be fastened together. Again, all ridge beam segments are similar in this example, and only the first ridge beam segment 48*a* will be described. The beam receiver 126 includes a top wall 128 that is shaped and sized to generally engage with the top wall 62 of the first ridge beam segment 48*a*. The beam receiver 126 also includes bottom wall 130 generally parallel to and spaced from the top wall 128 that is shaped and sized to generally engage with the bottom wall 64 of the first ridge beam segment 48*a*. The beam receiver 126 further includes a butt wall 132 extending between and generally perpendicular to the top wall 128 and the bottom wall 130. The top wall 128, the bottom wall 130, and the butt wall 132 define a chamber 133 into which the front or rear portion 58, 60 of the first ridge beam segment 48*a* can be inserted.

In this manner, an end portion 58, 60 of the first ridge beam segment 48*a* can be inserted into the chamber 133 of the beam receiver 126 such that the top wall 62 of the first ridge beam segment 48*a* engages the top wall 128 of the beam receiver 126, the bottom wall 64 of the first ridge beam segment 48*a* engages the bottom wall 130 of the beam receiver, and the end portion 58 or 60 butts up against the butt wall 132.

The beam receiver 126 also includes a first tab 134 extending forwardly out from the butt wall 132 that includes a first opening 136. The beam receiver 126 also includes a second tab 138 extending rearwardly out from the butt wall 132 that includes a second opening 140. The openings 136, 140 of the first and second tabs 134, 138 coordinate with the forward and rear slots 80 in the first ridge beam segment 48*a* such that a nut and bolt or other fastener system may be used to secure the first ridge beam segment 48*a* to the truss 54. Other known methods may be used to secure the first ridge beam segment 48*a* to the truss 54.

The truss 54 further includes a pair of blocks 142 extending downward from the left bottom side 84 and the right bottom side 88. When the truss 54 is assembled to the sidewall 22, the blocks 142 bear directly on the sidewall 22, as seen in FIG. 2. Fasteners can be used to secure the truss 54 to the sidewall 22, such as drilling a screw into a block 142 through the sidewall 22 (see FIG. 2). In another example, the blocks 124 can be dovetailed in construction and can be slid into recesses in the side wall 22 to maintain a secure connection between the truss 54 and the side wall 22.

Figure 8:
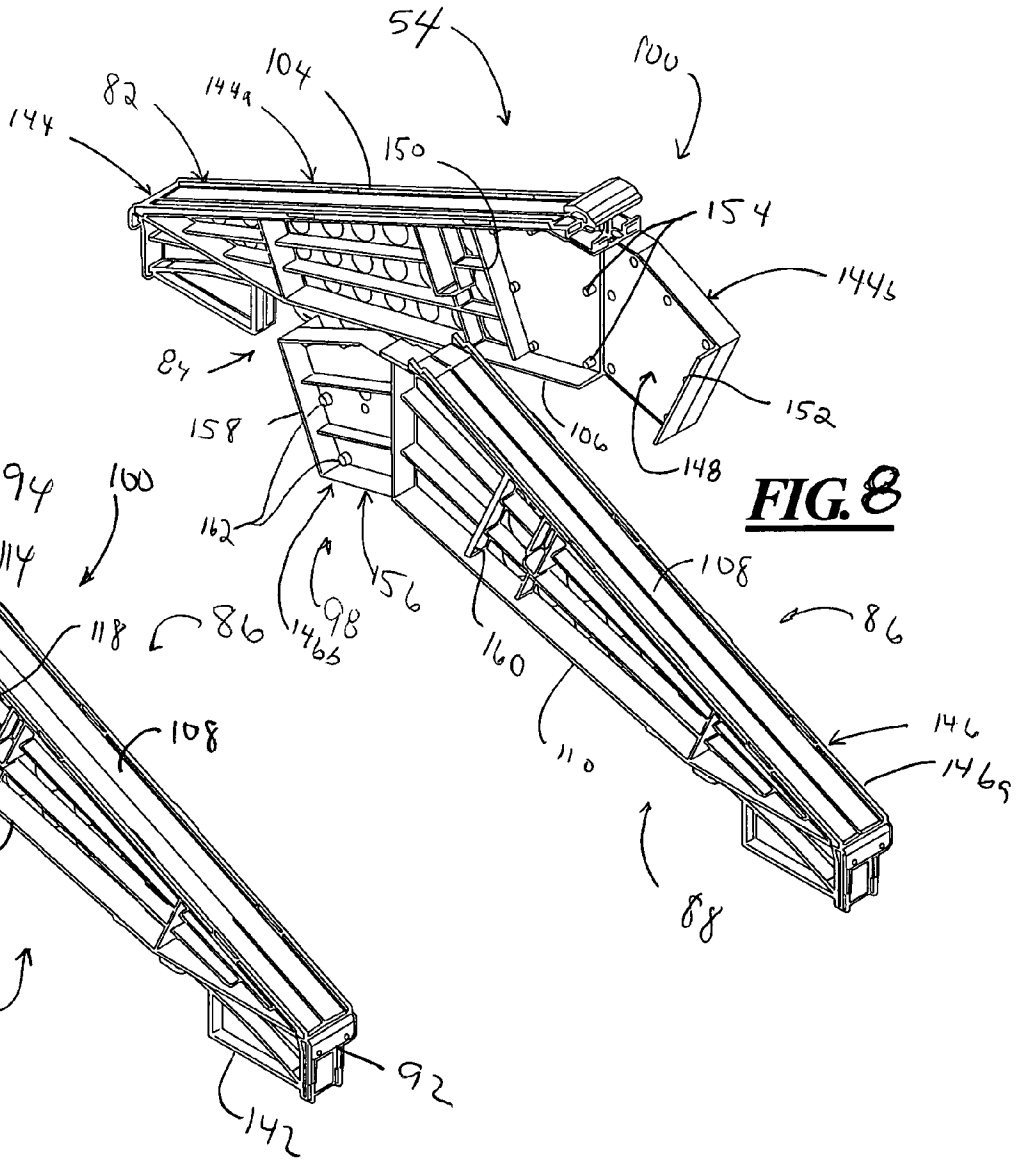
FIG. 8 depicts an exploded perspective view of the roof truss of FIG. 4.
Figure 4:
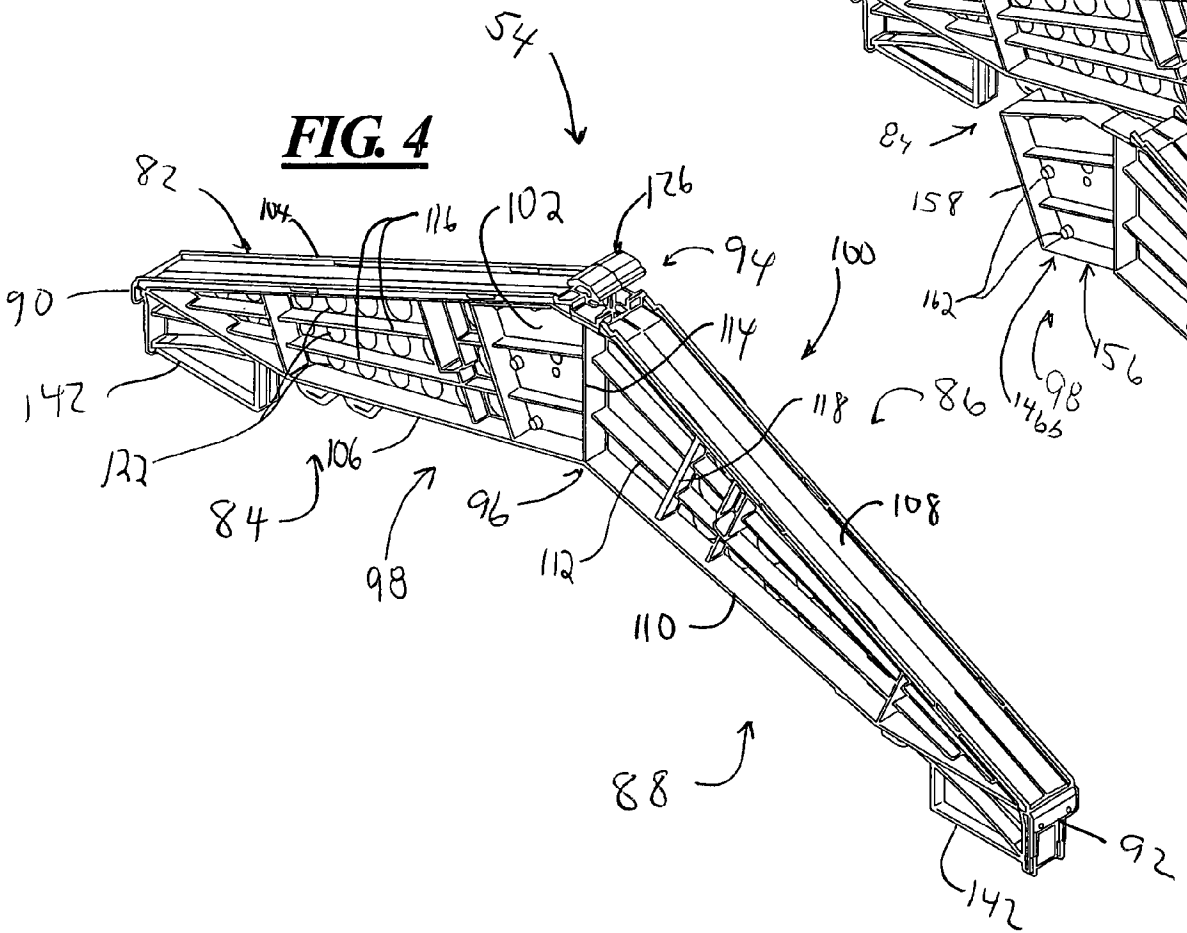
FIG. 4 depicts a perspective view of one example of a roof truss usable with the building of FIG. 1 constructed in accordance with the teachings of this disclosure.

Referring now to FIG. 8, an exploded view of an example of a truss 54 that is formed from a left truss section 144 and a right truss section 146 is depicted. While in this example the truss 54 is assembled from left and right truss sections 144, 146, the truss 54 can be manufactured as a single article. The left truss section 144 includes a left portion 144*a* and a center portion 144*b*. The right truss section includes a right portion 146*a* and a center portion 146*b*.

The left truss section 144 includes a pocket 148 disposed generally in the center portion 144*b* and defined in part by the first flange 104, the second flange 106, a left pocket wall 150, and a right pocket wall 152. The left truss section 144 further includes a series of bosses 154 extending to the front side 98 from the pocket 148.

The right truss section 146 includes a plug portion 156 disposed generally in the center portion 146*b* that is shaped and sized to be received in the pocket 148. The plug portion 156 includes a left plug wall 158, a right plug wall 160, and a series of open lips 162 to allow passage of the bosses 154 of the left truss 144 therethrough. The plug portion 156 also includes a slot (not shown) directly adjacent the right plug wall 160 to allow passage of the right pocket wall 152.

Figure 9:
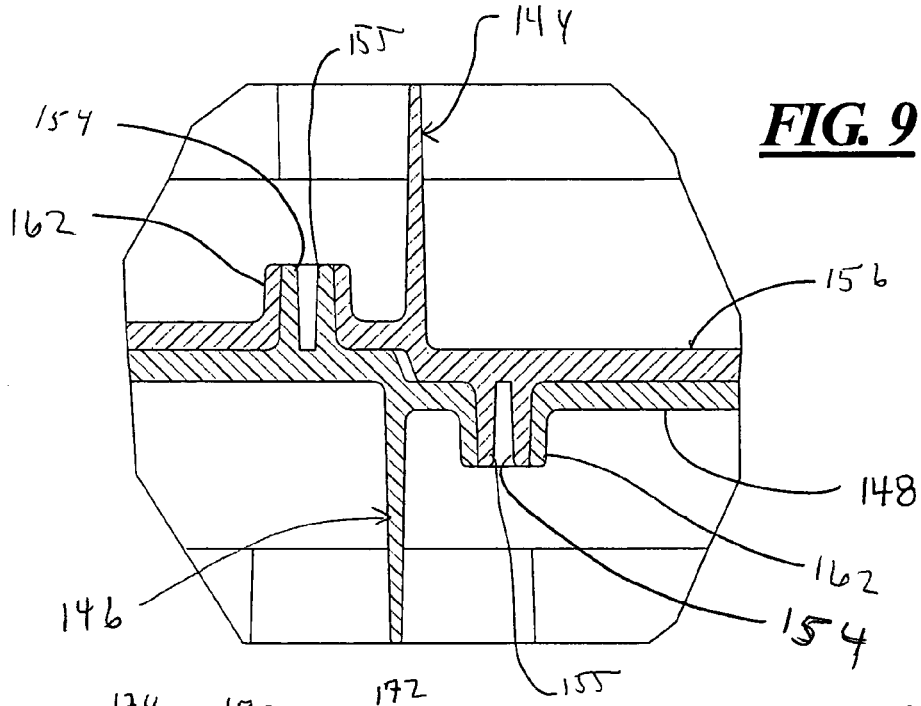
FIG. 9 depicts a fragmentary cross section of the roof truss taken along line 9-9 in FIG. 5.
Figure 10:
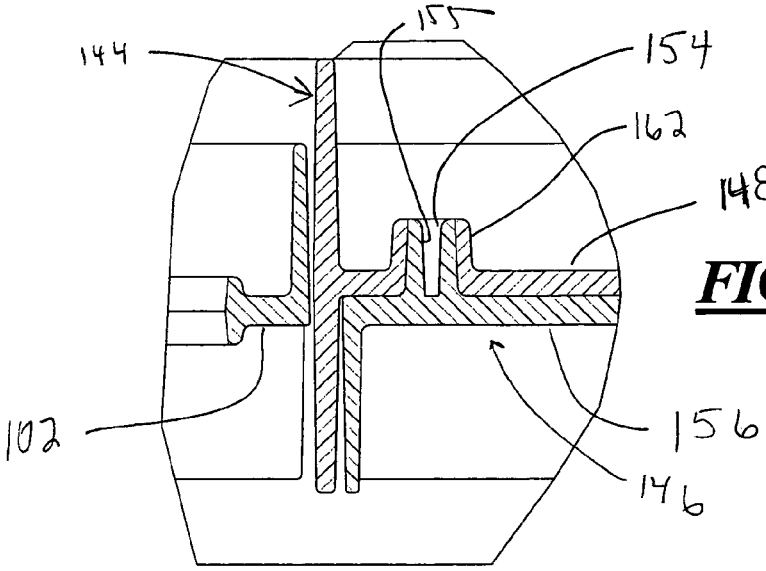
FIG. 10 depicts a fragmentary cross section of the roof truss taken along line 10-10 in FIG. 5.

As can be seen best in FIGS. 8-10, to assemble the left truss section 144 to the right truss section 146, the plug portion 156 of the right truss section 146 is disposed in the pocket 148 of the left truss section 144, with the right pocket wall 152 of the left truss section 144 extending through the slot of the right truss section 146. As best can be seen in FIGS. 9 and 10, the left truss section 144 also includes a plurality of open lips 162, and the right truss section 146 also includes a plurality of bosses 154. The bosses 154 of the left truss section 144 and right truss section 146 extend through the open lips 162 of the right truss section 146 and left truss section 144, respectively.

To fasten the left truss section 144 to the right truss section 146, a fastener such as a screw can be introduced into openings 155 in the bosses 154 such that the open lips 162 will be secured to the bosses 154 by the head of the screw or a washer. In this example, the screw can be very hard relative to the truss 54, such that the screw can cut its own threads as it is turned into the boss 154. When assembled, the truss 54 can be generally bilaterally symmetric.

Alternative structures and methods to connect the left truss section 144 and the right truss section 146 to one another, such as heat welding, sonic welding, ultrasonic welding, epoxy resins or other adhesives, or the like can be used to secure the two pieces.

When a downward force is exerted on the truss 54, the right pocket wall 152 bears against the right plug wall 160, and the left plug wall 158 bears against the left pocket wall 150. This helps to distribute the pressure and alleviate the force on the fasteners and the bosses 154.

Figure 11:
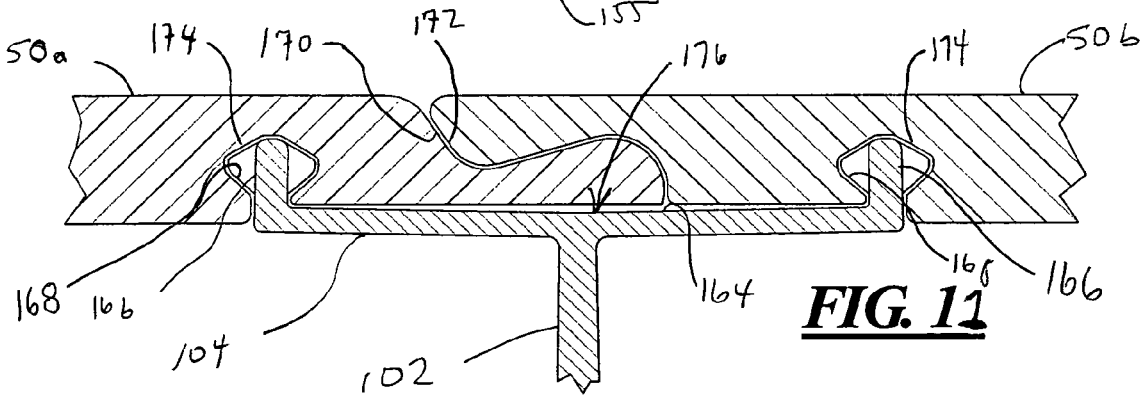
FIG. 11 depicts a fragmentary cross section of the roof truss taken along line 11-11 in FIG. 5.

Referring now to FIG. 11, a cross sectional view of the left top side 82 of the truss 54 and a pair of roof panels 50*a*, 50*b* is depicted. The first flange 104 includes a top surface 164 and a pair of guides 166 extending upward from the top surface 164. Disposed on each guide 166 is a series of detents 168 (also shown in FIG. 6).

Disposed on the first flange 104 of the truss 54 is a first roof panel 50*a* and a second roof panel 50*b*. The first roof panel 50*a* includes a contoured surface 170 that engages a similarly contoured surface 172 on the second roof panel 50*b* to create a substantially liquid tight seal. Both roof panels 50*a*, 50*b* include a receiver 174 that is complementary to the detents 168. Thus, the roof panels 50*a*, 50*b* are assembled to the truss 54 via a snap fit by placing the receivers 174 over the respective detents 168.

Further, the top surface 164 and the pair of guides 166 define a channel 176. Thus, any rain water that may seep through the joint between the two roof panels 50*a*, 50*b* is caught in the channel 176 and travels down the channel 176 towards the left and right sides 16, 18 of the building 10 and once it reaches the end of the channel 176 is released to fall to the ground. This aids in keeping water out of the building 10 during a rain storm.

In the present example, a building 10 with a first truss 54 and a second truss 56 is disclosed. In such a building 10 with more than one truss 54 the opening 122 of the first truss 54 is generally across from a respective opening 122 of the second truss. A handle 57*a* from a long-handled tool 57 can be passed through a selected opening 122 in the first truss 54 and then through a corresponding opening 122 in the second truss 56. The handle 57*a* rests in the openings 122 first and second truss 54, 56.

In one example, the openings 122 of the first truss 54 are at the same elevation as the openings 122 of the second truss 56. In a second example, the openings 122 of the first truss 54 may be slightly elevated with respect to the respective openings 122 of the second truss 56 to encourage the tool 57 to slide down to a stable position in which the implement 57*b* of the tool 57 such as the shovel head bears against the first truss 54. Further, it may be desired that the first truss 54 have larger openings 122 than the second truss 56 to ease insertion of the handles 57*a*.

In another example, a relatively short shed roof 24 may only incorporate one truss 54. The remainder of the roof 24 can be supported by beams or the gables 40, 42 or both. In this example, the vent 46 of the gable 40 or 42 may be generally across from the openings 122 of the first truss 54 may be used to support the handle 57*a* of a tool 57. Further, more or other recesses 46 may be introduced into the gable 40, 42 in addition to the vent 46. A long handled tool 57 can be stored by passing the handle 57*a* through a selected one of the openings

122 in the truss 54 such that an end of the handle 57*a* rests on a recess 46 in the gable 40, 42 or other beam structure.

The openings 122 allow long handle tools 57 to be suspended between the truss 54 and the gable 40, 42 or between multiple truss assemblies in the building 10 above the general storage space. This clears the wall surfaces for additional storage. Placement within the truss structure allows storage of long handle tools 57 above the normal headroom area within the shed or building 10. This leaves all of the wall space and floor space for other uses.

Round openings 122 are disclosed in this example. Round openings 122 help to minimize influence on the performance of the truss 54 by eliminating localized stress concentrations. Further, the truss 54 can be placed in any orientation and the openings 122 will have the same effect on performance.

In a further example, an integrally molded shelf holder can be provided as part of the truss 54 to provide shelving along the sides of the building 10. The shelf holder structure can depend from either the bottom left side 84, the bottom right side 86 adjacent the respective left or right corner 90, 92, or both, so that, when installed in a building 10, the holder is adjacent the side wall 22. A shelf can then be suspended from or mounted to the holders.

The first truss 54 can be fabricated from virtually any suitable material, but in one example is formed from plastic such as polypropylene, polyethylene, polystyrene, or the like. Metals or woods or other suitable materials can also be used. Also, the manufacturing process can vary according to the needs of a selected materials. Injection molding is one of many possible fabrication technique examples.

Although certain examples of roof truss constructions have been described herein in accordance with the teachings of the present disclosure, the scope of coverage of this patent is not limited thereto. On the contrary, this patent covers all embodiments of the teachings of the disclosure that fairly fall within the scope of permissible equivalents.

I claim:

1. A building comprising:

a side wall defining a storage space;

a roof supported above the storage space; and a truss supporting the roof, the truss having at least one tool handle opening;

wherein the truss comprises a first section and a second section, the first section including a pocket with a plate and pocket sidewalls extending away from the plate, and the second section including a plug portion with a second plate and plug sidewalls, wherein the first section and the second section are fastened together such that at least one of the pocket sidewalls passes into the plug portion and at least one of the plug sidewalls bears on one of the pocket sidewalls to resist rotation of the first section relative to the second section;

the plug portion further comprising an open lip, the pocket further comprising a hollow boss, wherein the hollow boss is disposed inside the open lip.

2. The building of claim 1, further comprising a second truss supporting the roof.

3. The building of claim 2, the second truss further comprising a second tool handle opening.

4. The building of claim 3, wherein the second tool handle opening is substantially at the same elevation as the first tool handle opening of the first truss.

5. The building of claim 3, wherein the tool handle opening of the first truss is higher in elevation than the second tool handle opening of the second truss.

6. The building of claim 3, wherein the tool handle of the first truss is larger than the tool handle opening of the second truss.

7. The building of claim 1, the truss further comprising a plurality of tool handle openings.

8. The building of claim 1, wherein the tool handle opening is round with radiused edges.

9. The building of claim 1, the truss further comprising:

a panel;

a first support side and a second support side each on a top side of the panel and each adapted to support the roof, the first support side and the second support side meeting at an apex and defining an angle less than or equal to 180 degrees; and a first base side and a second base side each on a bottom side of the panel, the first base side and the first support side defining a first acute angle, the second base side and the second support side defining a second acute angle, and the first base side and the second base side meeting at a base vertex and defining an angle greater than 180 degrees.

10. The building of claim 9, the truss further comprising a plurality of ribs adapted to increase the strength of the truss.

11. The building of claim 10, the truss further comprising a plurality of tool handle openings interspersed between the ribs.

12. The building of claim 9, the truss further comprising a hook adapted to suspend flexible objects.

13. The building of claim 1, the truss further comprising a pair of blocks extending from the bottom side of the truss, the blocks adapted to engage the sidewall of a building to secure the truss to the building.

14. A building comprising:

a side wall defining a storage space;

a roof supported above the storage space;

a truss supporting the roof, the truss having at least one tool handle opening;

the truss further including a first support side and a second support side each on a top side of the truss and each adapted to support the roof, the first support side and the second support side meeting at an apex and defining an angle less than or equal to 180 degrees, the truss further including a first base side and a second base side each on a bottom side of the truss, the first base side and the first support side defining a first acute angle, the second base side and the second support side defining a second acute angle, and the first base side and the second base side meeting at a base vertex and defining an angle greater than 180 degrees, the first support side of the truss including a flange, the flange including a pair of guides extending upward along the entire length of the first support side to define a channel adapted to conduit rainwater;

at least one receiver disposed generally across from the tool handle opening and provided in a part of the building separate from the truss;

wherein the tool handle opening and the receiver are spaced apart and adapted to each receive the handle of a long handled tool and support the long handled tool above the storage space.

15. The building of claim 14, the truss further comprising a detent extending out from one of the guides adapted to engage a roof panel to secure a roof panel to the truss.

16. A building comprising:

a side wall defining a storage space;

a roof supported above the storage space;

a truss supporting the roof, the truss having at least one tool handle opening; and at least one receiver disposed generally across from the tool handle opening and provided in a part of the building separate from the truss;

wherein the tool handle opening and the receiver are spaced apart and adapted to each receive the handle of a long handled tool and support the long handled tool above the storage space; and wherein the truss comprises a first section and a second section, the first section including a pocket with a plate, pocket sidewalls extending away from the plate, and a hollow boss, the second section including a plug with a second plate, plug sidewalls, and an open lip, wherein the first section and the second section are fastened together by fastening the first plate to the second plate with the hollow boss disposed inside the open lip and the plug sidewalls bearing on the pocket sidewalls to resist rotation of the first section relative to the second section.

* * * * *

UNITED STATES PATENT AND TRADEMARK OFFICE

CERTIFICATE OF CORRECTION

PATENT NO. : 7,610,724 B2
APPLICATION NO. : 10/874658
DATED : November 3, 2009
INVENTOR(S) : David A. Houk, Jr.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1235 days.

Signed and Sealed this

Twelfth Day of October, 2010

David J. Kappos

David J. Kappos
*Director of the United States Patent and Trademark Office*